US005957771A

United States Patent [19]

Baek

[11] Patent Number: 5,957,771

[45] Date of Patent: Sep. 28, 1999

[54] AROMATIC SPRAY DRIVING APPARATUS OF AIR CONDITIONER

[75] Inventor: Chul-Ho Baek, Seongnam, Rep. of Korea

[73] Assignee: Samsung Electronics Co., Ltd., Suwon, Rep. of Korea

[21] Appl. No.: 08/987,587

[22] Filed: Dec. 10, 1997

[30] Foreign Application Priority Data

May 7, 1997 [KR] Rep. of Korea ..... 97-17539
May 7, 1997 [KR] Rep. of Korea ..... 97-17540

[51] Int. Cl.[6] ..... F24F 3/16

[52] U.S. Cl. ..... 454/233; 422/124; 454/328

[58] Field of Search ..... 454/157, 233, 454/234, 328; 62/78, 303; 422/124

[56] References Cited

U.S. PATENT DOCUMENTS 5,297,988 3/1994 Nishino et al. ..... 454/157 X
5,664,423 9/1997 Akazawa ..... 62/78
5,755,103 5/1998 Na et al. ..... 62/78

FOREIGN PATENT DOCUMENTS 1-317825 12/1989 Japan ..... 454/157

*Primary Examiner*—Harold Joyce
*Attorney, Agent, or Firm*—Burns, Doane, Swecker & Mathis, L.L.P.

[57] ABSTRACT

An aroma-spraying mechanism is provided in an air conditioner to suppress unpleasant odors generated in the air conditioner. The air conditioner includes an air inlet, and an inlet opening and closing mechanism disposed at the inlet. That mechanism includes a framework and inlet opening/closing vanes rotatably mounted on the framework. The aroma spraying mechanism includes a replaceable aroma container mounted on the framework. The container includes a depressible spray head. A driver mounted on the framework includes a plunger for depressing the spray head. A user can manipulate keys on a control panel to select the spray intervals and spray duration, whereby the plunger is automatically actuated during an air conditioning operation.

3 Claims, 10 Drawing Sheets

300
POWER SOURCE MEANS
302
OPERATION MANIPULATING MEANS
306
ROOM TEMPERATURE DETECTING MEANS
310
SUCTION INLET OPENING DETECTING MEANS
320
DISPLAY MEANS
304
CONTROLLING MEANS
308
SUCTION INLET OPENING CLOSING DRIVING MEANS
312
VALVE DRIVING MEANS
314
AIR DIRECTION CONTROL MEANS
316
COMPRESSOR DRIVING MEANS
318
FAN MOTOR DRIVING MEANS
141
210
315
317
25

AROMATIC SPRAY DRIVING APPARATUS OF AIR CONDITIONER

BACKGROUND OF THE INVENTION

1. Field of the Invention

The present invention relates to an air conditioner with an aromatic spray apparatus attached at an indoor unit, and more particularly to an aromatic spay driving apparatus of the air conditioner for keeping room air pleasant by spraying an aromatic at the time intervals and time duration set as desired.

2. Description of the Prior Art

Generally, an air conditioner includes a heating apparatus for supplying warm air by heating cold room air and a cooling apparatus for supplying cool air by cooling warm room air. Besides, a heating cum cooling apparatus is also included for a dual function of the heating and cooling operations and for an air purifying function which cleans the polluted room air.

FIGS. 1 and 2 illustrate an indoor unit of the heating cum cooling apparatus (generally, referred as an air conditioner) among conventional air conditioners. As shown in FIG. 1, an suction grille member(5) is provided at the lower front surface of an indoor unit main body (hereinafter referred to as a main body) with a plurality of suction inlets(3) to suck room air and with a plurality of discharge outlets(7) at the upper front surface of the main body to discharge the heat-exchanged air, i.e., the heated or cooled air, that is sucked through the suction inlets(3).

Furthermore, the discharge outlets(7) comprises vertical vanes(9) and horizontal vanes(11) for controlling the vertical and horizontal directions of the air discharged indoors therethrough(7), a covering member(15) attached for forming an external appearance thereof and for protecting the interior parts therein, and a operating part(17) disposed at the lower portion of the cover member(15) for controlling overall operation modes (automatic, cooling, dehumidifying, blowing, heating, etc.) of the air conditioner, a start or stop operation thereof and the amount and direction of the air discharged through the discharge outlets(7).

As shown in FIG. 2, there are a filtering member(19) disposed at the inner side of the suction grille member(5) for filtering dust and foreign objects floating with the room air sucked through the suction inlets(3) and a heat-exchanger (21) behind the filtering member(19) for heat-exchanging into heated air or cooled air through evaporative latent heat of a coolant.

In addition, the heat-exchanger(21) is disposed thereover with a blower fan(23) (hereinafter referred to as an indoor fan) which rotates according to operation of an indoor fan motor in order to suck the room air through the suction inlets(3) and, at the same time, to discharge through the discharge outlets(7) the air heat-exchanged at the heat-exchanger(21). The indoor fan(23) is also provided with a duct member(27) outside thereof for covering the indoor fan(23) and for guiding the flow of the air sucked through the suction inlets(3) and discharged through the discharge outlets(7).

In the air conditioner which has a dual function of the heating and cooling operations as described above, when an user turns on a start/stop key (hereinafter referred to as an operation key) with a remotely controlled unit or with the operating part(17) and selects a desired operation mode (for instance, cooling), the indoor fan(23) is rotated according to operation of an indoor fan motor(25) for sucking the room air into the main body(1) through the suction inlets(3).

The dust and foreign objects floating in the room air is sucked through the suction inlets(3) to be removed by the filtering mcmber(19), and the purified room air is then heat-exchanged into cool air at the heat-exchanger(21) through evaporative latent heat of a coolant.

The heat-exchanged and cooled air at the heat-exchanger (21) is guided upwards by the duct member(27) and is discharged indoors through the discharge outlets(7), to thereby cool indoors as the direction of the discharged air is controlled according to the angles of the vertical vanes(9) and horizontal vanes(11).

However, there is a problem in the conventional air conditioner in that even when the air conditioner is not in operation, the suction inlets(3) are left open to get dust and foreign objects infused and accumulated on the surface of the heat-exchanger(21), thereby deteriorating the function of the heat-exchanger(21).

Furthermore, there is another problem in the conventional air conditioner in that absence of a separate aromatic spraying apparatus reduces the pleasantness of room air due to an unpleasant odor generated by accumulation of the dust and foreign objects in the room air infused through the suction inlets(3) into the filtering member(19) and into the heat-exchanger(21) and by decomposition of chemical products like an insulation material provided therein.

SUMMARY OF THE INVENTION

The present invention is presented to solve the aforementioned problems and it is an object of the present invention to provide an aromatic spaying driving apparatus of an air conditioner and method thereof, wherein an user's simple key manipulation drives the apparatus to automatically adjust the solenoid valve to spray out an aromatic at the predetermined time intervals and time duration in order to suppress an unpleasant odor generated by accumulation of dust and foreign objects or by decomposition of chemical parts like an insulation material inside the air conditioner and to spray out indoors an aromatic for improving the pleasantness of the room air.

In order to achieve the objects of the present invention, there is provided an aromatic spray driving apparatus of an air conditioner having suction inlets to suck room air, a heat-exchanger to heat-exchange the room air sucked through the suction inlets and suction inlet opening and closing means to prevent dust and foreign objects from being infused through the suction inlets, wherein the apparatus comprises:

- aromatic spraying means for spraying the predetermined amount of the aromatic included in the air conditioner;
- an aromatic spraying operation selection key for actuating the aromatic spraying operation of the aromatic spraying means;
- aromatic spraying driving means having a separate aromatic spraying operation key for setting the aromatic spraying time intervals and duration;
- aromatic spraying controlling means to control the operation of the aromatic spraying means; and
- a solenoid valve to drive the aromatic spraying means for the predetermined time intervals and time duration according to the control of the aromatic spraying controlling means.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Figure 1:
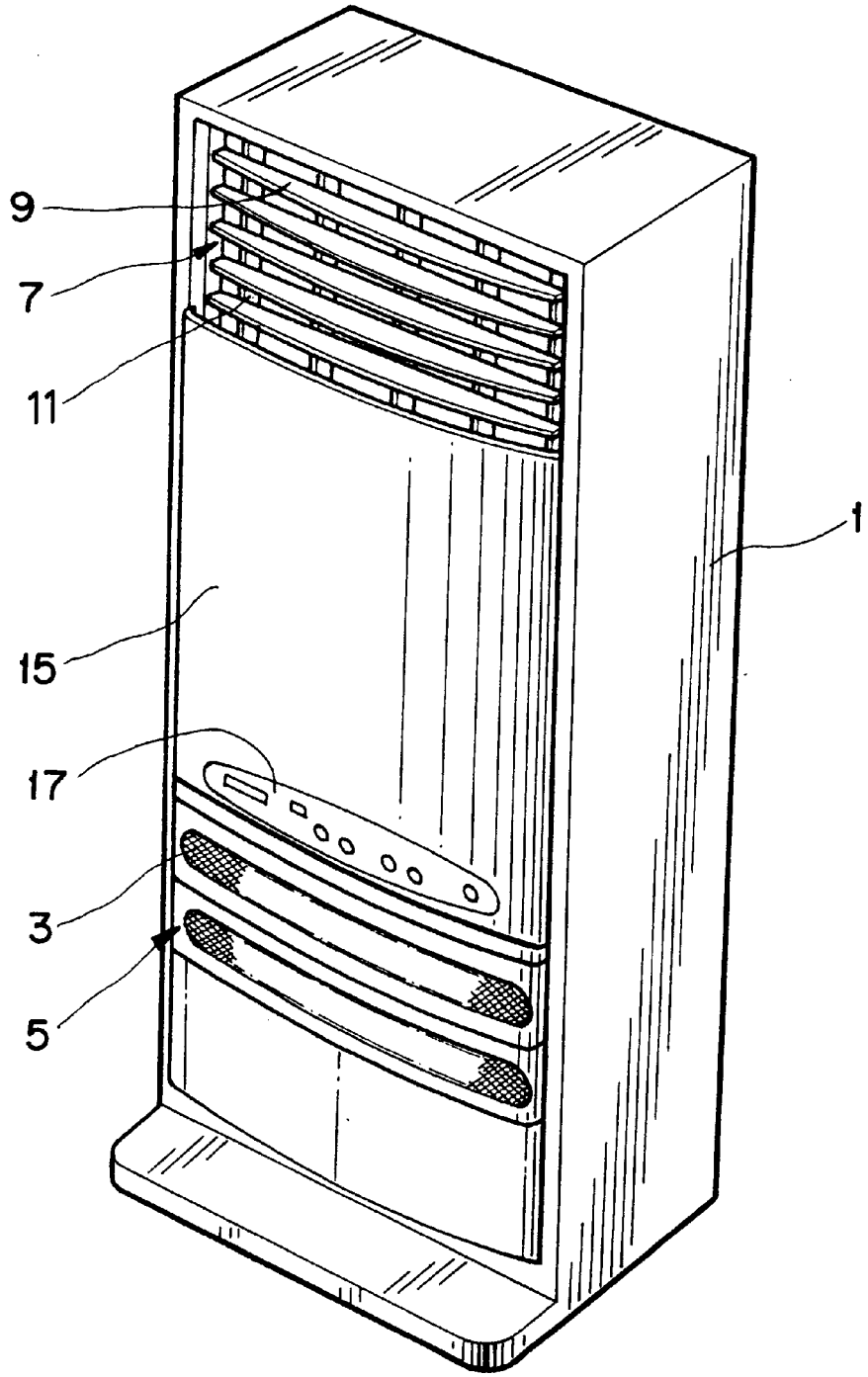
FIG. 1 (PRIOR ART)
FIG. 1 is a perspective view for illustrating an indoor unit of a conventional air conditioner.
Figure 2:
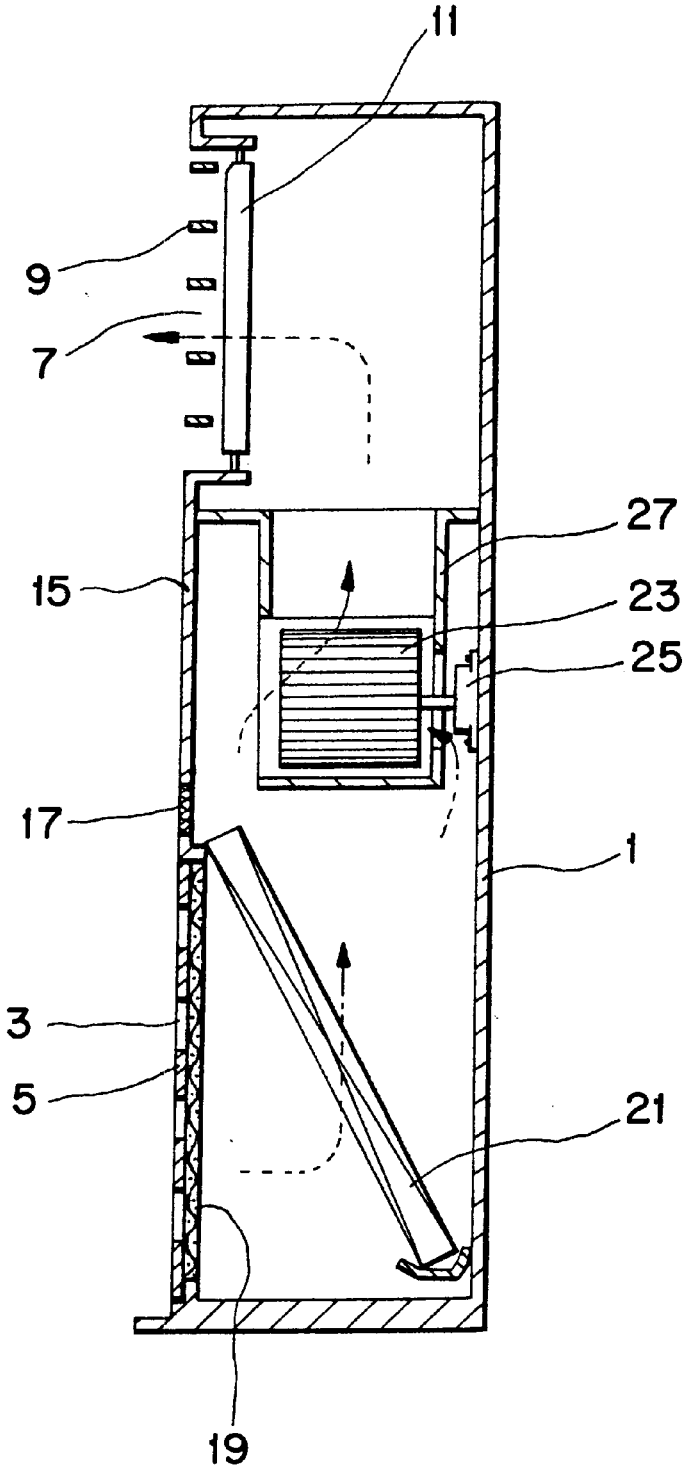
FIG. 2 (PRIOR ART)
FIG. 2 is a longitudinal sectional view of FIG. 1.

The present invention is described in detail with reference to the accompanying drawings. Throughout the drawings, like reference numerals and symbols are used for designation of like or equivalent parts or portions for simplicity of illustration and explanation, and redundant references will be omitted.

Figure 3:
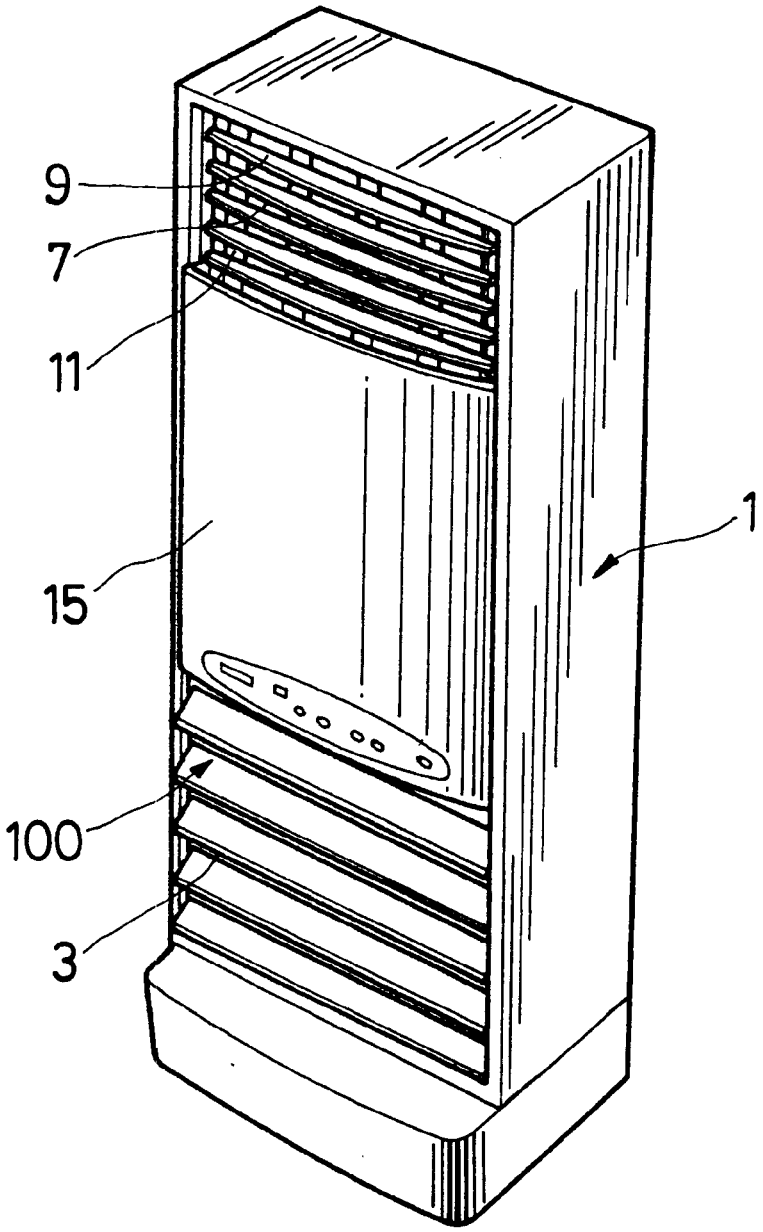
FIG. 3 is a perspective view for illustrating an indoor unit of an air conditioner according to the present invention.

As shown in FIG. 3, suction inlets(3) are provided at the lower area of a main body of an air conditioner with suction inlet opening and closing means(100) for opening the suction inlets to efficiently suck room air therethrough when the air conditioner is in operation, for closing the suction inlets to prevent dust and foreign objects from being infused inside the main body(1) and for forming an pleasing external appearance when the air conditioner is in a stand-by operation (at the non-operation state).

Figure 4:
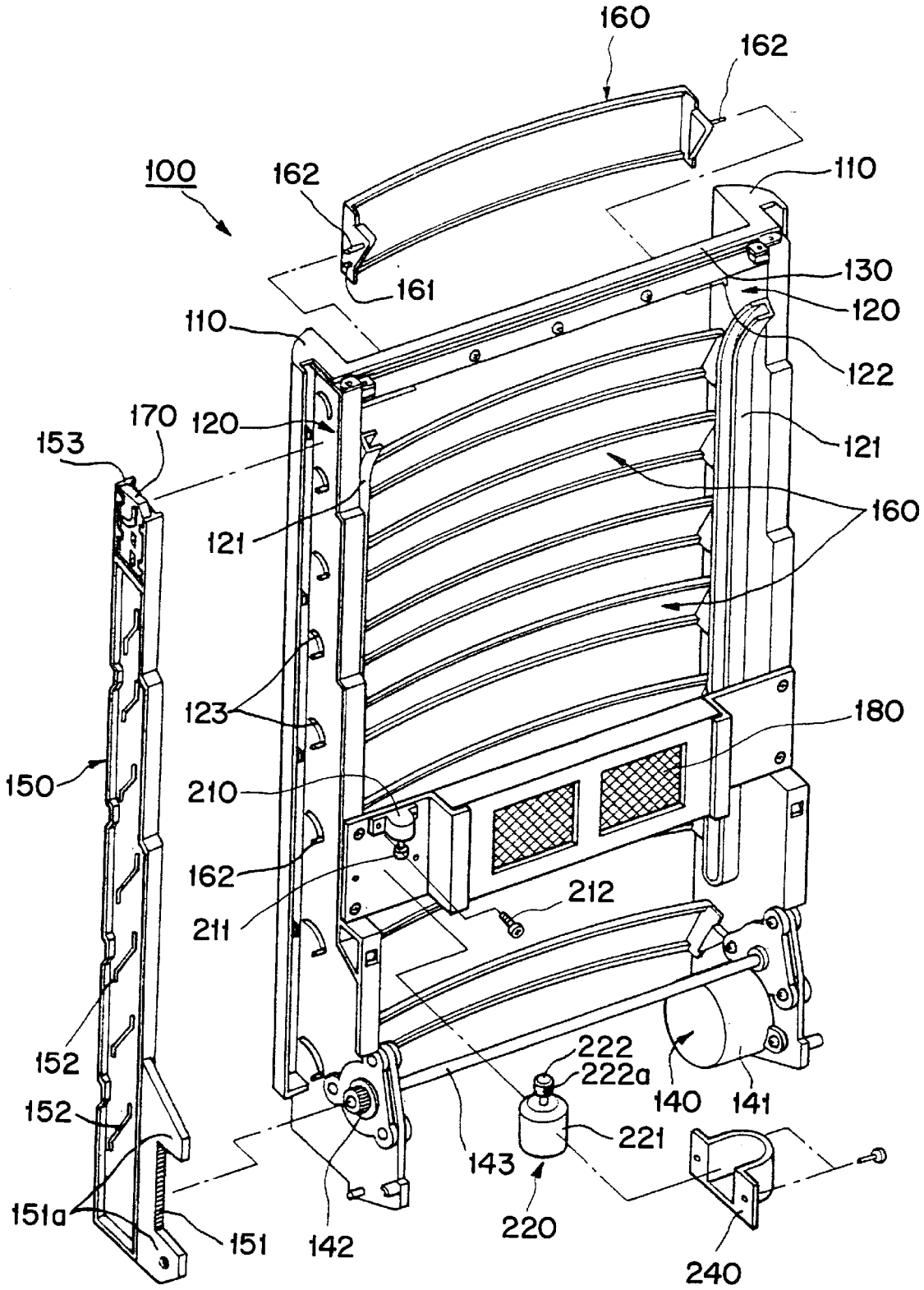
FIG. 4 is an analyzed perspective view of suction inlet opening and closing means and an aromatic attachment apparatus according to the present invention.
Figure 5:
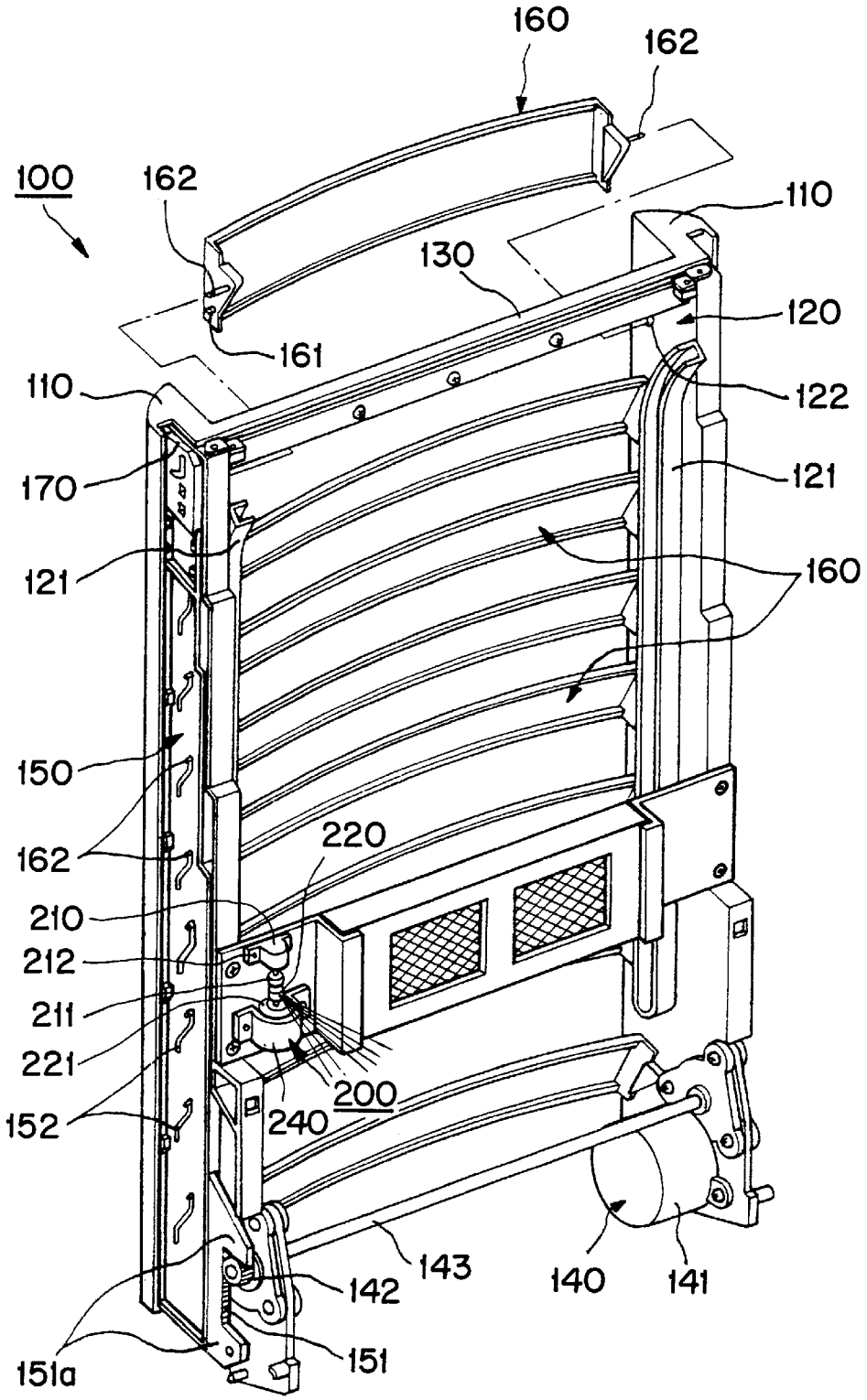
FIG. 5 is an assembling perspective view of suction inlet opening and closing means and an aromatic attachment apparatus according to the present invention.

As shown in FIGS. 4 and 5, the suction inlet opening and closing means comprises:

a frame work including a pair of grille side frames(110) installed at left and right sides of the front suction inlets(3) with easy attachment and detachment; a pair of guide members(120) disposed at the inner side of the both grille side frames(110); a space maintaining member(130) between upper ends of the both grille side frames(110) to keep the predetermined distance therebetween, operating means(140) between both ends of both guide members(120) to keep the predetermined distance therebetween and to transmit power for operation; a pair of slider members(150) at respective external sides of the guide members to vertically move along with the operating means(140); a plurality of suction inlet doors(160) hinged at the inner side of the guide members(120) to enable the suction inlets(3) to rise and fall for opening and closing in response to the operation of the slider members(150); and the assisting slider member(170) disposed at the upper ends of the slider members(150) without disturbing the vertical movement of the slider members(150) to prevent the uppermost suction inlet doors(160) from breaking away from the effective stroke distance and to induce overall simultaneous operation of all the suction inlet doors.

The guide members(120) includes at the inner rear ends thereof a pair of protruded filter guide rails for permitting filtering member(19) conveniently attached and detached, a plurality of the hinge grooves(122) formed in a circular shape at the predetermined intervals to hinge the both lower ends of the suction inlet doors(160) toward the inner side thereof without penetration, and a plurality of guide holes (123) penetrated as long holes toward both central sides thereof at the predetermined distance intervals among hinge grooves(122) to enable both central parts of the suction inlet doors(160) to get hinged and move vertically within the predetermined effective stroke distance.

Furthermore, the operating means(140) includes a suction inlet motor(141) disposed at the bottom portion of the inner side of one of the guide members(120) and a rotary shaft (143) installed between the lower ends of the guide members (120) rotating with transmission of the driving force of the suction inlet motor(141) for simultaneous rotation of pinions (142) fixed at both ends of the guide members(120). The pinions(142) are fixed with compression at both ends of the rotary shaft(143), penetrating outwards from inside of the guide member(120).

Each slider member(150) comprises: a rack gear part(151) at each lower side of the slider member to change rotating movement of the pinion(142) into rectiliner movement by gear-contacting, the pinion(142) being fixed at an end of the rotary shaft(143) of the operating means(140); a plurality of slot holes(152) penetrated toward both front ends at the predetermined vertical intervals correspondingly to a plurality of guide holes(123) to allow the suction inlet doors (160) penetrating the guide holes(123) of the guide members (120) to swing vertically by being hinged at both central sides thereof(160); and a guide part(153) formed at each upper external side of the slider member to enable the assisting slider member(170) to ascend higher than the upper end of the slider member(150) by way of resilience of the assisting slider member(170) or to descend as low as the upper end of the slider member(150) by way of the compression.

Furthermore, at both ends of the rack gear part(151) are hitching jaws(151*a*) protruded to prohibit the pinion(142) from breaking away when the slider member(150) is making a rectilinear movement by way of rotation of the pinion (142), and at both uppermost ends are the upper slot holes (152) in a angular bent shape to prevent respective second hinge axle formed at the suction inlet doors(160) from breaking away.

Each suction inlet door(160) includes a first hinge axle (161) protruded at the lower end of each side to get hinged at the hinge grooves(122) formed at each guide member (120) and a second hinge axle(162) protruded at the center of each side to get inserted at the slot hole(152) formed at each slider member(150) after getting penetrated into the guide holes(123) of the guide member(120). The first hinge axle(161) is shorter than the second hinge axle(162) to facilitate the operation of the slider members(150).

In addition, aromatic spraying means(200) is installed at an inner side of the suction inlet opening and closing means(100) for spraying the predetermined amount of an aromatic (perfume) toward the heat-exchanger(21) to remove the unpleasant odor generated from the main body (1) and, at the same time, to discharge the sprayed aromatic outside to purify the room air.

The aromatic spraying means(200) includes a solenoid valve(210) and an aromatic container(220) mounted at the guide member(120) for spraying the predetermined amount of an aromatic toward the heat-exchanger(21) to remove the unpleasant odor generated from the main body(1) and, at the same time, to discharge out the aromatic for improving the pleasantness of the room air.

The solenoid valve(210) includes a plunger(211) moving by way of a magnetic effect (not shown), and the aromatic container(220) is connected at the rear part of the guide member(120) by way of a braket(240) for its convenient change.

The aromatic container(220) is fixed by bracket(240) in the guide member(120) so as not to be shaken and is allowed to get the predetermined amount of the aromatic refilled, to thereby form an opening on the aromatic container body unit(221). A dispensing header cover(222) is to cover the opening of the body unit(221) and is also provided with a spraying hole(222*a*) on one side thereof for spraying the aromatic outside elastically moving vertically by way of the pressure of the plunger(211). On the other hand, the numeral 180 is an electric precipitator screwed at the lower rear side of the guide members(120).

Figure 6:
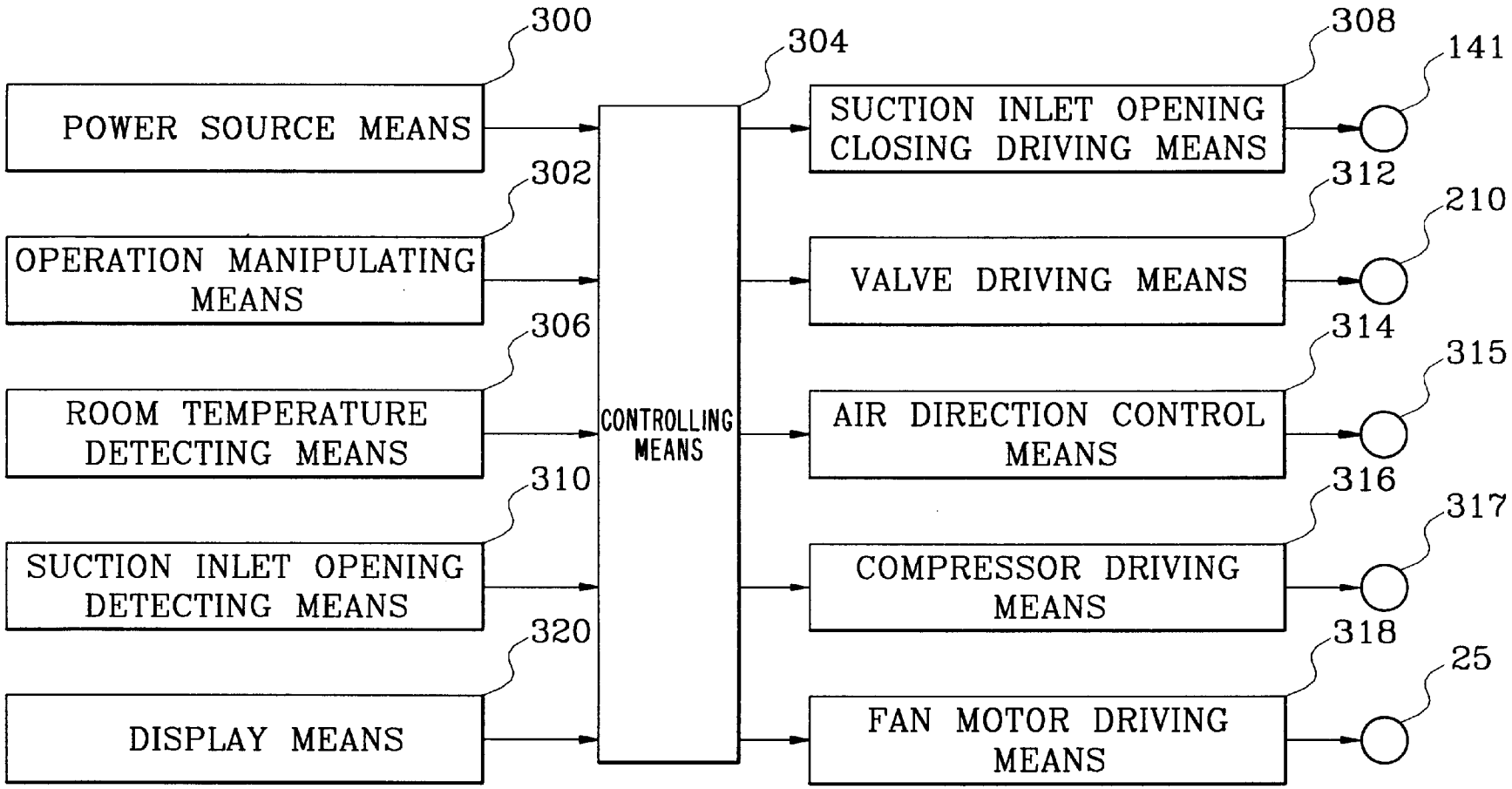
FIG. 6 is a schematic block diagram for controlling an aromatic spray driving apparatus in accordance with an embodiment of the present invention.
Figure 7:
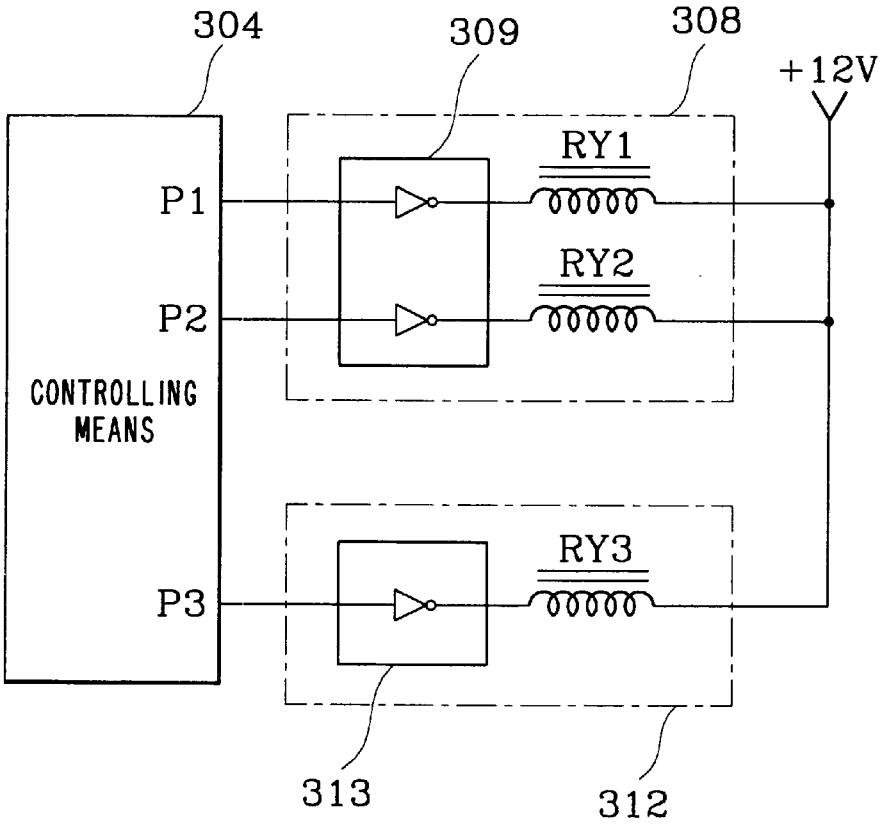
FIG. 7 is a detailed circuit diagram for explaining functions of principal parts in accordance with the present invention.
Figure 7A:
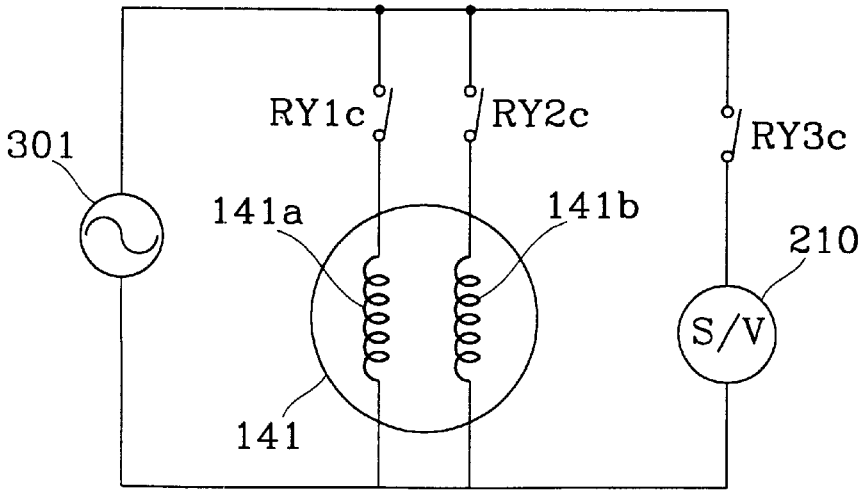
FIG. 7*a* is a motor circuit diagram.

Next, the opening and closing operations of the suction inlet door(160) and the aromatic spraying operation of the aromatic container(220) are described with accompanying circuit diagrams with reference to FIGS. 6 and 7.

As illustrated in FIGS. 6 and 7, power source means(300) is applied to convert commercial alternating current voltage supplied from the alternating current power terminal(301) into the predetermined direct current voltage. The operation manipulating means(302) comprises a plurality of selection keys for all operation modes (auto, cooling dehumidifying, blowing, heating and the like), for an amount (strong air, weak air, or soft air) of the air discharged through the discharge outlets(7) and for temperature set as desired, wherein the operation manipulating means(302) comprises operation keys to start or stop the air conditioner, an aromatic spraying key for selecting an aromatic spraying operation of the aromatic container(220) and an aromatic spraying operation key for setting the aromatic spraying time intervals and time duration.

The controlling means(304) is a microcomputer to initialize the operation of the air conditioner by receiving the direct current voltage supplied from the power source means (300) and, additionally, to control overall operation of the air conditioner according to the operation signals from operation manipulating means(302), wherein the controlling means(304) controls the aromatic spraying operation of the aromatic container(220) by using the operation manipulating means(302) at the aromatic spraying time intervals and time duration set as desired.

Room temperature detecting means(306) adjusts a room temperature (Tr) to the temperature (Ts) which an user sets with the operation manipulating means(302) in order to carry out the simultaneous operations of sucking and discharging air in the air conditioner by detecting temperature (Tr) of the room air sucked through the suction inlets(3).

Suction inlet opening and closing operation means(308) controls the operation of the suction inlet motor(141) by receiving a control signal sent from the controlling means (304) and by moving the suction inlet doors(160) which open and close the suction inlets(3) if an operation signal (start or stop) is operated with the operation manipulating means(302). The suction inlet opening and closing means (308) comprises an inverter IC(309) to invert a high level of the opening or closing control signal output from the output terminals (P1 and P2) of the controlling means(304), a relay(RY1) driven by receiving the direct current voltage (12 V) generated from the power source means(300) to enable the suction inlet motor(141) to rotate in a forward direction when a low level of an opening control signal transformed by the inverter IC(309) is output, and another relay (RY2) driven by the direct current voltage(12 V) output from the power source means(300) to rotate the suction inlet motor (141) in a reverse direction when a low level of a closing control signal is output.

The suction inlet opening detecting means(310) checks whether the suction inlet doors(160) open the suction inlets (3) according to an elevating position of the slider member (150) which moves upwards as the suction inlet motor(141) gets operated.

The valve driving means(312) controls operation of the solenoid valve(210) for spraying the aromatic filled at the aromatic container(220) according to a control signal generated from the controlling means(304) at the preset aromatic spraying time intervals and time duration as an aromatic spraying control signal is sent by the operation manipulating means(302), wherein the valve driving means (312) comprises an inverter IC(313) for inverting the 'high' or 'low' level of an aromatic spraying control signal generated from the output terminal (P3) of the controlling means (304) and a third relay (RY3) to be driven by the direct current voltage (12 V) supplied by the power source means (300) to enable the solenoid valve(210) to be switched on or off when the aromatic spraying control signal inverted by the inverter IC(313) is output.

Air direction controlling means(314) controls an air direction motor(315) to get the air discharged through the discharged outlets(7) into the predetermined horizontal and vertical directions evenly all over a room while compressor driving means(306) controls operation of a compressor(317) by way of the control signal generated from the controlling means(304) according to a temperature difference between the temperature (Ts) preset by an user with an operation manipulating means(302) and the temperature (Tr) detected by the room temperature detecting means(306).

Fan motor driving means(318) controls the indoor fan(23) by controlling the rotation number thereof to blow the air (cooled or heated air) heat-exchanged at the heat-exchanger (21) by way of the control signal generated from the controlling means(304) toward the air directions set by the user with the operation manipulating means(302). Display means(320) displays the operation mode (auto, cooling, dehumidifying, blowing, heating and so on) selected with the operating manipulating means(302) and the overall operational state of the air conditioner. On the other hand, the inverter IC(309) of the suction inlet opening and closing driving means(308) and the inverter IC(313) of the valve driving means(312) can be made by an integral IC.

Figure 8A:
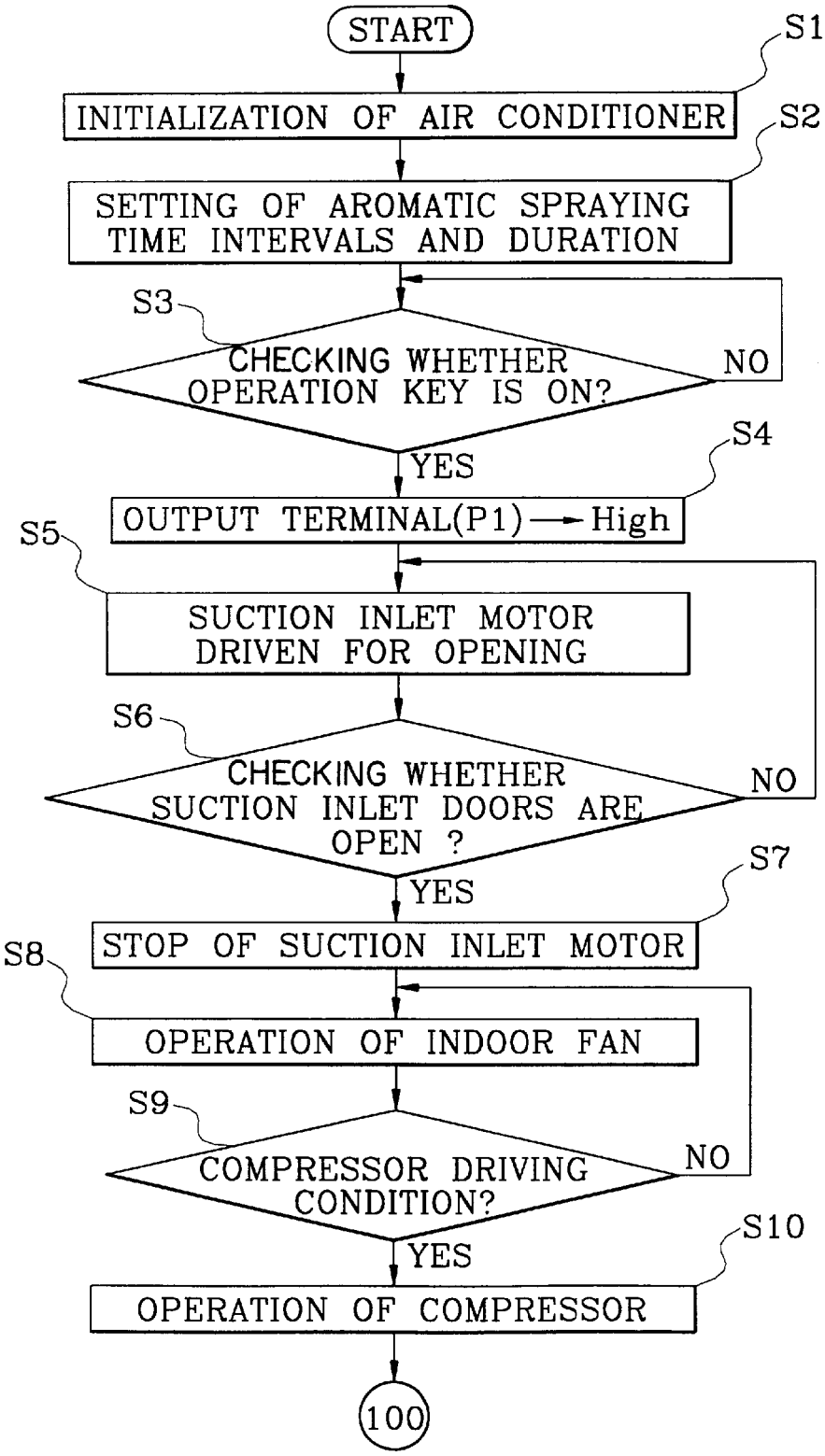
FIGS. 8*a*, 8*b* and 8*c* are flowcharts for illustrating the operational procedure of an aromatic spray driving apparatus in accordance with the present invention.
Figure 8B:
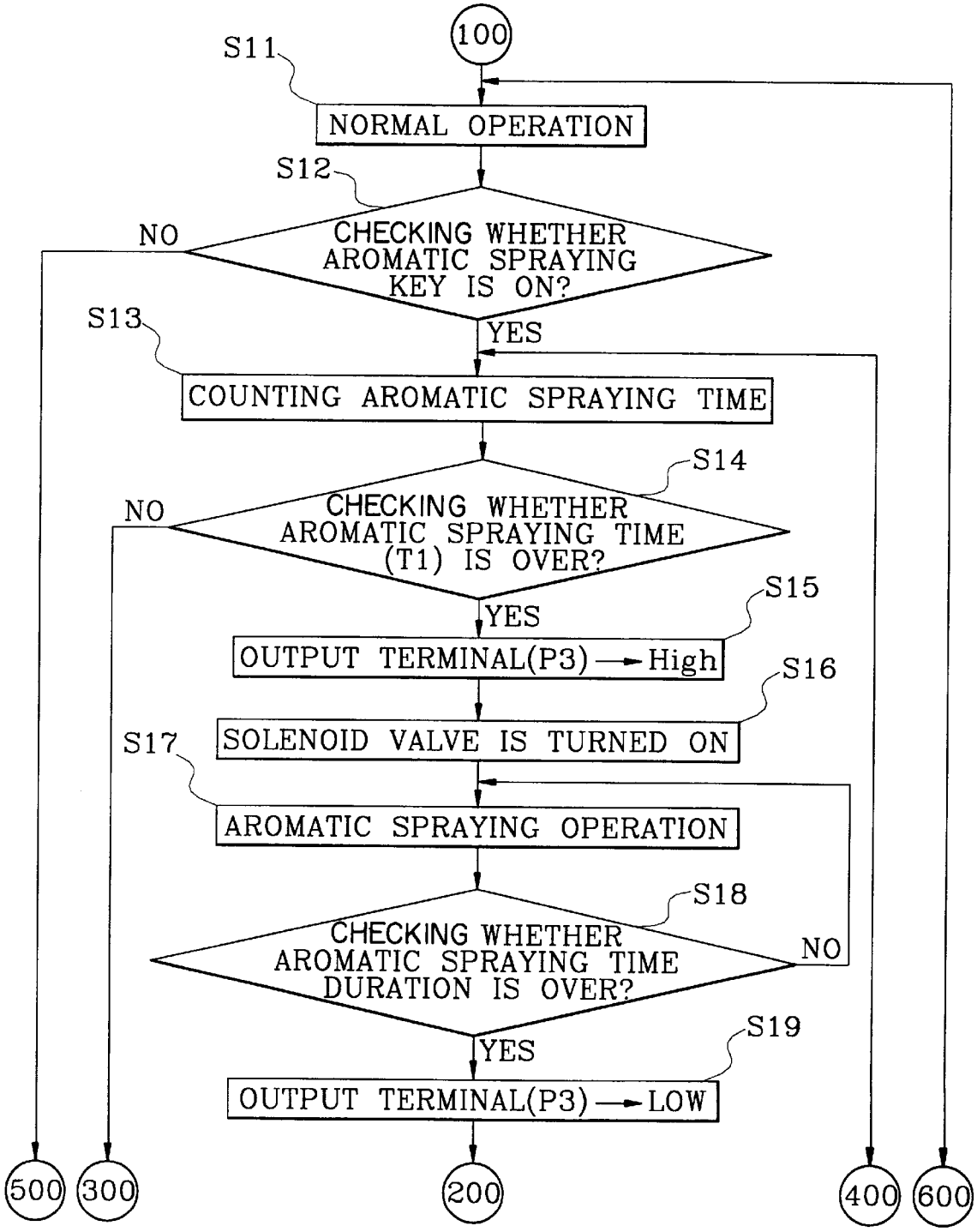
Figure 8C:
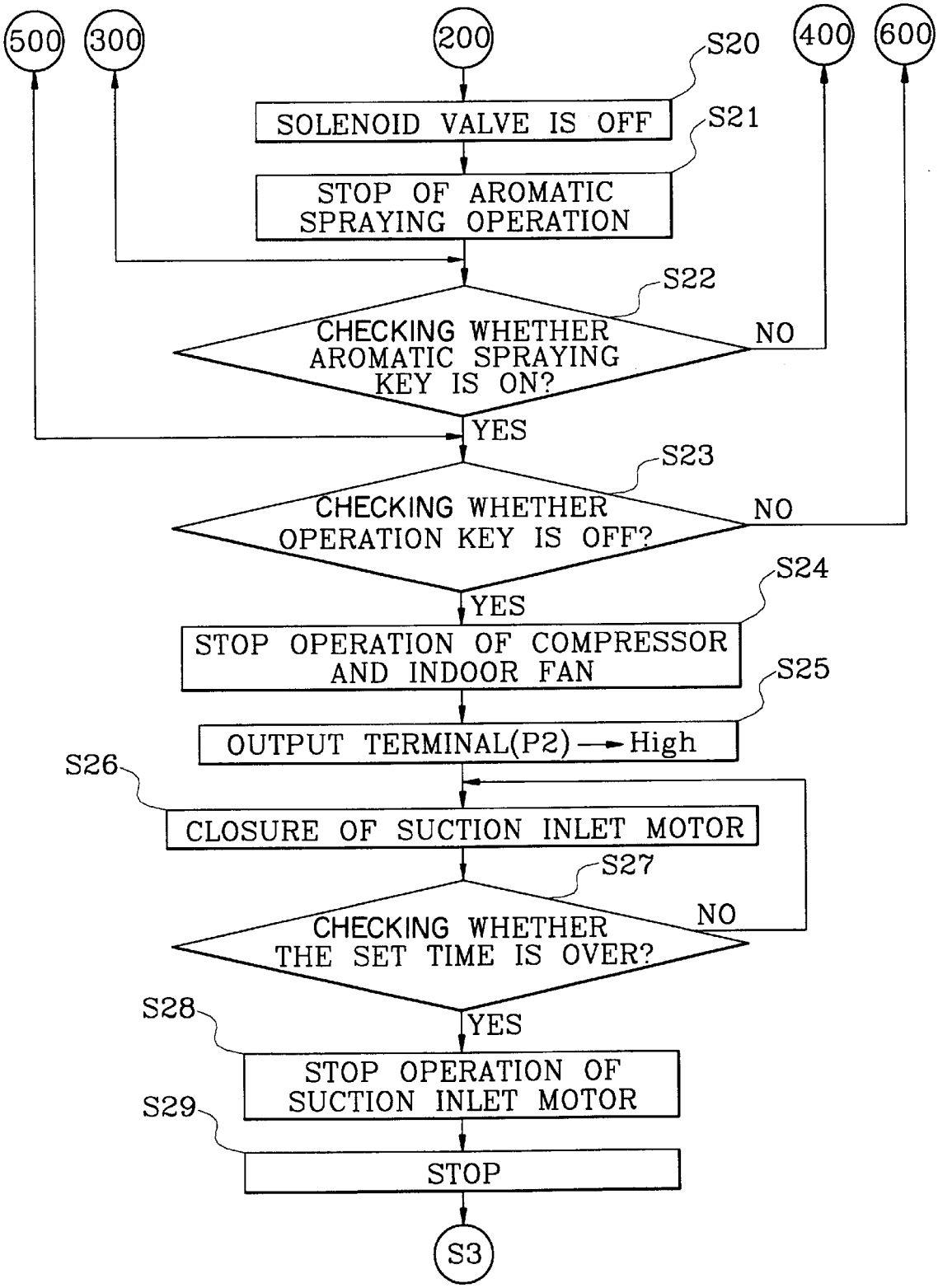

Hereinafter, an aromatic spray driving apparatus and the effect of its method are described. FIGS. 8*a* and 8*b* are flowcharts for illustrating the operational procedures of the aromatic spray driving apparatus of an air conditioner in accordance with the present invention and reference symbol S in the drawings refers to method steps. It is presumed that the suction inlets(3) are closed as an initial condition for describing the operational procedures.

First of all, when power is applied to the air conditioner, the power source means(300) converts the commercial alternating current voltage supplied from the alternating current power terminal(301) into a predetermined direct current voltage needed for driving the air conditioner and thereafter outputs same to respective driving, circuits and to controlling means(304).

At step S1, the direct current voltage output from the power source means(300) is received by the controlling means(304) to thereby initialize the air conditioner. At step S2 an operation key is pressed with the operation manipulating means(302) to select an operation mode (auto, cooling, dehumidifying, blowing, heating and the like) of the air conditioner and to set a temperature (Ts) an aromatic spraying time interval (T1) and time duration (T2) of the aromatic spraying means(200) as desired, whereby an operation start signal and other operation selection signals are sent to the controlling means(304).

At step S3, the controlling means(304) checks whether an operation key of the operation manipulating means(302) is turned on. If the operation key is not turned on (in case of NO), flow returns to step 3 and repeated operations subsequent to step S3 are performed with the air conditioner being maintained at an operation stand-by state.

As a result of the discrimination at step S3, if the operation key is turned on (in case of YES), flow proceeds to step S4, where the controlling means(304) opens the closed suction inlets(3) by sending a high level of a control signal from the output terminal (P1) to the suction inlet opening and closing driving means(308).

Therefore, the high level of the opening control signal output from the output terminal (P1) of the controlling means(304) is inverted into a low level one through the inverter IC(309), and the direct current voltage (12 V) transmitted from the power source means(300) drives a relay (RY1), to thereby cause the contact point (RY1*c*) of the relay (RY1) to be closed.

If the contact point (RY1*c*) is closed, flow proceeds to step S5, where the alternating current voltage output from the alternating current power terminal(301) is transmitted to the wound rotor(141*a*) of the suction inlet motor(141) to drive in a forward direction and to simultaneously rotate a pinion (142) and the other pinion(142) formed at the other end by way of the rotary shaft(143). The rotating pinions(142) elevate the rack gear parts(151) gear-contacted at the lower ends of both slider members(150). When the slider member (150) is guided toward the external side of the guide members(120) to make a rectilinear movement downwards, a plurality of slot holes(152) disposed at the slider members (150) are simultaneously moved downwards to penetrate into the guide holes(123) of the guide members and to move downwards the second hinge axle(162) of the suction inlet doors(160) inserted at the slot holes(152), whereby a plurality of the suction inlet doors(160) open the suction inlets(3) as they rotate about the hinge groove(122) formed at the guide member(120) and the first hinge axle(161) protruded at both sides of the suction inlet doors(160).

The assisting slider members(170) are installed at the uppermost external surfaces of the slider members(150) to make a vertical movement via the guide parts(153). When the slider members(150) are moving upwards, the assisting slider members(170) are simultaneously elevating upwards to the predetermined point by way of the frictional effect caused by the second hinge axle(162) which penetrates into the slot holes(152) and inserts into the slot groove(171) of the assisting slider member(170). When the second hinge axle(162) reaches the uppermost point of the guide member (120), the elevation of the assisting slider member(170) stops.

At the same time, when the slider members(150) reaches the uppermost point of the guide members(120), the elevation of the slider members(150) is blocked by getting the lower end thereof contacted to the hitching jaws (not shown) formed at the lower ends of the rack gear parts(151) and pinions(142). Therefore, the assisting slider members(170) are accommodated at the guide part(153), and a spring (not shown) inserted between supporting protruders(not shown) of the guide part(153), and supporting groove (not shown) of the assisting slider member(170) is compressed. Therefore, the second hinge axle(162) of the suction inlet doors(160) is not to fall out of the slot holes(52) of the slider members (150). When the slider members(150) are elevated upwards, they are guided to return to the second hinge axle(162) and slot holes(52) to prevent any operational defect in advance.

At step S6, the suction inlet opening detecting means (310) detects the position of the slider members(153) moving upwards by way of the operation of the suction inlet motor(141), and the controlling means(304) checks whether the suction inlet doors(160) are open according to the signal detected by the suction inlet opening detecting means(310). At this time, if the suction inlet doors(160) are not opened (in case of NO), flow returns to step S5, repeated operations subsequent to S5 are performed to continuously drive the suction inlet motor(141) until the suction inlet doors(160) are opened.

As a result of the discrimination of step S6, if the suction inlet doors(160) are opened, flow proceeds to step S7. At the step S7, the suction inlet opening and closing driving means(308) stops operation of the suction inlet motor(141) according to a low level of an opening control signal output from the output terminal (P1) of the controlling means(304) to complete the opening operation of the suction inlet doors(160).

If the suction inlet doors(160) are opened, flow proceeds to step S8, where the indoor fan driving means(318) drives the indoor fan(23) by controlling the rotation number of the indoor fan motor(25) according to the control of the controlling means(304). When the indoor fan(23) is in operation, the room air starts to be sucked through the suction inlets(3) into the main body(1). At that time, the room air temperature (Tr) is detected by the room temperature detecting means(306).

At step S9, a compressor driving condition is discriminated as the room temperature (Tr) detected by the room temperature detecting means(306) is compared with the temperature (Ts) set by the user with the operation manipulating means(302). The compressor driving condition means that the room temperature(Tr) detected by the room temperature detecting means(306) is higher than the temperature (Ts) set by the user in case of the cooling operation or that the room temperature(Tr) is lower than the temperature(Ts) set by the user in case of the heating operation.

As a result of the discrimination at step S9, if it is not in the compressor(317) driving condition (in case of NO), flow returns to step S8 to detect the room temperature (Tr) and repeated operations subsequent to S8 are performed. When the compressor(317) driving condition is in, flow proceeds to step S10, where the controlling means(304) determines an operation frequency of the compressor(317) according to the temperature difference between the room temperature(Tr) and the set temperature(Ts) and outputs a compressor driving control signal to the compressor driving means(316). Therefore, the compressor driving means(316) drives the compressor(317) at the operation frequency determined at the controlling means(304).

If the compressor(317) is rendered operative, flow proceeds to step S11, where the indoor fan(23) is driven to suck the room air through the suction inlets(3) to the main body(1), to thereby enable the sucked room air to get heat-exchanged into cool air or warm air via evaporative latent heat of a coolant while passing at the heat-exchanger (21).

The cool or warm air heat-exchanged at the heat-exchanger(21) is moved upwards to carry out the air conditioning as the air flowing directions are controlled according to the angles of the rotary vertical(9) and horizontal vanes(11) installed at the discharge outlets(7).

When the air conditioner is in the normal operation, flow proceeds to step S12, where it is confirmed that an aromatic spraying key in the operation manipulating means(302) is turned on. When the aromatic spraying key is turned on, flow proceeds to step S13, where the controlling means(304) operates a timer embedded inside to drive the solenoid valve(210) at the preset aromatic spraying time intervals(T1) and time duration(T2).

Accordingly, flow proceeds to step S14, where it is checked whether the preset spraying time interval (T1: aromatic spraying time interval) set with the operation manipulating means(302) is over the time counted by the controlling means(304). If the aromatic spraying time interval (T1) is over the time counted by the controlling means (304), flow advances to step S15, where the controlling means(304) sends out a high level of a control signal through the output terminal (P3) to spray the aromatic into the main body(1).

Therefore, a high level of the spraying control signal generated from the output terminal (P3) of the controlling means(304) is inverted into a low level one through the inverter IC(313). The relay (RY3) is driven by the direct current voltage (12 V) transmitted from the power source means(300), to thereby close the contact point (RY3*c*) of the relay (RY3).

If the contact point (RY3*c*) of the relay (RY3) is closed, flow proceeds to step S16, where the alternating voltage output from the alternating current power terminal(301) is sent to the solenoid valve(210) to be turned on. At that time, the plunger(211) moves downwards to enable its free end to press the cover(22) of the aromatic container(220) fixed via the braket(240) behind the guide members(120).

At step S 17, the cover(222) of the aromatic container (220) is pressed by the plunger(211), to thereby pump out and spray the predetermined amount of the aromatic toward the heat-exchanger(21) through the spraying hole(222*a*) on the cover(222). The aromatic sprayed toward the heat-exchanger(21) is spread throughout all directions by the room air sucked into the main body(1) by the turning effect of the indoor fan(23) to remove the unpleasant odor generated from dust and foreign objects accumulated in the main body(1) or from its insulation materials and mechanical parts. At the same time, the aromatic is discharged out along with the heat-exchanged air through the discharge outlets(7) to improve the pleasantness of the room air.

After the aromatic is sprayed, flow proceeds to step S18, where the controlling means(304) counts the aromatic spraying time interval operated by the solenoid valve(210) in order to check whether the preset aromatic spraying time duration (T2: a most adequate aromatic spraying time duration necessary for removing the unpleasant odor of the air conditioner and for cleaning the room air) is over. If the aromatic spraying time duration (T2) is not over, flow returns to step S17 and repeated operations subsequent to step S17 are performed while the aromatic is continuously sprayed for the predetermined time duration (T2), As a result of the discrimination at step S18, if the aromatic spraying time duration (T2) is over, flow proceeds to step S19, where the controlling means(304) outputs a low level of a control signal through the output terminal (P3) to the valve driving means(312) to stop the aromatic spraying operation. Therefore, a low level of a control signal is inverted into a high level one through the inverter IC (313) output from the output terminal (P3) of the controlling means(304) to open the contact point (RY3*c*) of the relay (RY3) without transmission of electric current to the relay (RY3).

If the contact point (RY3*c*) of the relay (RY3) is opened, flow advances to step S20, where the alternating current voltage output from the alternating current power terminal (301) to the solenoid valve(210) is shut to turn off the solenoid valve(210) to allow the plunger(211) to move upwards, whereby its free end pressed on the cover(222) of the aromatic container(220) is released.

Flow advances to step S21, where the aromatic spraying operation is stopped as the cover(222) of the aromatic container(220) is separated from the container(221). Flow advances to step S22, where it is confirmed that the aromatic spraying key of the operation manipulating means(302) is turned off. If the aromatic spraying key is not turned off (in case of NO), flow returns to step S13 and repeated operations subsequent to S13 are performed.

As a result of the discrimination at step S22, if the aromatic spraying key is turned off (in case of YES), flow advances to step 23, where it is confirmed that the operation key of the operation manipulating means(302) is turned off. If the operation key is not turned off, flow returns to step S11 and repeated operations subsequent to S11 are performed.

As a result of the discrimination at step S23, if the operation key is turned off, flow proceeds to step S24, where the controlling means(304) sends control signals to stop the compressor(317) and an indoor fan motor(25) respectively to the compressor driving means(316) and fan motor driving means(318).

By the control of the controlling means(304) the compressor driving means (316) stops the compressor according to the control of the controlling means(304) and the indoor fan motor(25) stops the indoor fan(23).

Flow advances to step S25, where a high level of a control signal is output through the output terminal(P2) to the suction inlet opening and closing driving means(308) to enable the controlling means(304) to close the opened suction inlets(3). Therefore, the high level of a control signal generated from the output terminal (P2) of the controlling means(304) is inverted into a low level one through the inverter IC (309). The relay (RY2) is driven by the direct current voltage (12 V) output from the power source means (300) to close the contact point (RY2*c*) of the relay (RY2).

If the contact point (RY2*c*) of the relay (RY2*c*) is closed, flow advances to step S26, where the alternating current voltage is transmitted from the alternating current power terminal(301) to the wound rotor(141*b*) of the suction inlet motor(141) to drive the suction inlet motor(141) in a reverse direction and to rotate the pinions(142) via a rotary shaft (143). The rotating pinions(142) lower the rack gear parts (151) gear-contacted at the lower ends of both slider members(150).

When the slider member(150) is guided toward the external side of the guide members(120) to make a rectilinear movement upwards, a plurality of the slot holes(152) disposed at the slider members(150) are simultaneously moved upwards to penetrate into the guide holes(123) of the guide members and to push upwards the second hinge axle(162) of the suction inlet doors(160) inserted at the slot holes(152), whereby the plurality of the suction inlet doors(160) close the suction inlets(3) as they rotate about the hinge groove (122) formed at the guide member(120) and the first hinge axle(161) protruded at both sides of the suction inlet doors (160).

The assisting slider members(170) is installed at the uppermost external sides of the slider members(150) to make a vertical movement via the guide part(153). When the slider members(150) is moving downwards, the assisting slider members(170) is also lowering downwards slower than the slider members(150) by way of the elasticity of the spring (not shown) and the frictional effect caused by the second hinge axle(162) which penetrates into the slot holes (152) and inserts into the slot groove(171) of the assisting slider member(170), thereby getting protruded to the uppermost external end of the slider member(150). The slot groove(171) formed at the inner side of the assisting slider member(170) is positioned at an extended line to the upper cut part of the slot hole(152) formed at the uppermost end of the slider member(150), to thereby halt the second hinge axle(162) of the uppermost suction inlet door(160) which may break away from the effective stroke distance of the slot hole(152), preventing the defective operation of the suction inlet doors(160).

At step S27, the stopping time of the suction inlet motor (141) is counted at the controlling means(304) to check whether the counted time is over the predetermined time (T3: an experimentally obtained time for closing the suction inlet doors: about 11.5 seconds). If the counted time is not over the predetermined time (T3), flow returns to step S26 and repeated operations subsequent to step S26 are performed to close the suction inlet doors(160) while the suction inlet motor(141) is in continuous operation.

As a result of the discrimination at step S27, if the counted time is over the predetermined time (T3), it is confirmed that the suction inlet doors(160) is firmly closed. Flow proceeds to step S28, where the suction inlet opening and closing driving means(308) completes the closure of the suction grille(34) by stopping the operation of the suction inlet motor(141) according to a low level of the closing control signal output from the output terminal (P2) of the controlling means(304).

Accordingly, flow advances to step S29, where the controlling means(304) keeps the air conditioner at an operation stand-by state until the operation key of the operation manipulating means(302) is turned on. When necessary, all the steps subsequent to step S3 are to be repeated.

On the other hand, as a result of the discrimination at step S12, if the aromatic spraying key is not turned on, repeated operations subsequent to step S23 are performed. As a result of the discrimination at step S14, if the aromatic spraying time interval (T1) is not over (in case of NO), flow returned to step S22 and repeated operations subsequent to step S22 are repeated.

According to the aromatic spray driving apparatus thereof in the present invention, there are advantages in that the aromatic can conveniently be sprayed according to desired time intervals and time duration by simple manipulation of a key to get the solenoid valve automatically controlled, and in that the unpleasant odor generated from the dust and foreign objects accumulated in the main body or from the chemical parts like insulation materials is suppressed by spraying an aromatic to thereby improve the pleasantness of the room air.

What is claimed is:

1. An air conditioner comprising:

an air inlet for admitting room air into the air conditioner;

a heat exchanger disposed downstream of the air inlet for heat exchanging room air;

a discharge outlet for discharging heat exchanged air back into the room;

a fan for circulating air through the air inlet, the heat exchanger, and the discharge outlet, an air inlet opening and closing mechanism disposed between the air inlet and the heat exchanger for preventing dust and foreign objects from entering through the air inlet, the air inlet opening and closing mechanism including a framework and at least one opening/closing element mounted on the framework;

an aroma spraying apparatus for spraying an aroma into the air, comprising:

a replaceable aroma container disposed on a downstream side of the framework and including a depressible spray head in which an aroma outlet is disposed, a removable bracket for removably mounting the aroma container on the downstream side of the framework;

an automatically actuable driver mounted on the downstream side of the framework and including a movable plunger arranged to depress the spray head for spraying aroma into room air admitted through the air inlet, a manually actuable operation selection mechanism for selecting an operation of the aroma spraying apparatus, and aroma spraying time intervals and duration, and an automatic spray controller operably connected to the driver and to the operation selection mechanism for controlling actuation of the driver.

2. The air conditioner according to claim 1 wherein the driver includes an electromagnetic force generator for moving the plunger.

3. The air conditioner according to claim 1 wherein the fan is situated between the heat exchanger and the air discharge outlet.

* * * * *